US007603958B2

(12) United States Patent
Gonen

(10) Patent No.: US 7,603,958 B2
(45) Date of Patent: Oct. 20, 2009

(54) LIGHT-WEIGHT, SOFT WING-SAIL FOR WIND-PROPELLED VEHICLE

(76) Inventor: Ilan Gonen, 23 Hohit Street, Ramat-HaSharon (IL) 47226

( * ) Notice: Subject to any disclaimer, the term of this patent is extended or adjusted under 35 U.S.C. 154(b) by 24 days.

(21) Appl. No.: 12/003,758

(22) Filed: Dec. 31, 2007

(65) Prior Publication Data

US 2009/0165689 A1 Jul. 2, 2009

(51) Int. Cl.
*B63B 35/00* (2006.01)

(52) U.S. Cl. ..... 114/102.29; 114/39.29

(58) Field of Classification Search ..... 114/39.29, 114/102.22, 102.29, 102.33, 102.32
See application file for complete search history.

(56) References Cited

U.S. PATENT DOCUMENTS 4,624,203 A * 11/1986 Ferguson ..... 114/102.26
4,685,410 A * 8/1987 Fuller ..... 114/39.31
6,863,008 B2 * 3/2005 Gonen ..... 114/102.26

FOREIGN PATENT DOCUMENTS

GB 2008514 A * 6/1979

* cited by examiner

*Primary Examiner*—Ed Swinehart

(57) ABSTRACT

A light-weight soft wing-sail for a wind-propelled vehicle includes a free standing rotating mast to be mounted in a vertical position on the vehicle and, three fully battened sail panels that together define the skin of the wing sail. Spreaders extend transversely of the mast and impart to them a selected airfoil shape having a leading edge fore of the mast and a trailing edge aft of the mast. Two vertical tracks secured to both sides of the mast top and to the outer ends of each spreader. Sliders are secured to the sail panels and are slidable in the tracks, such as to permit hoisting and reefing each of the sail panels independently along the tracks. A boom is pivotally coupled to the mast and a ram is secured on one side to the lower spreader and on the other side to the boom such that the leading edge and the trailing edge define one wing-sail unit and trims the airfoil shape. An outhaul line pulls the clews of both trailing edges together through a block to evenly tension rearwardly the clews of the trailing edge and also to permit each of the clews to independently slide along the boom when the airfoil shape is changed.

13 Claims, 5 Drawing Sheets

LIGHT-WEIGHT, SOFT WING-SAIL FOR WIND-PROPELLED VEHICLE

FIELD AND BACKGROUND OF THE INVENTION

The present invention relates to wind-propelled vehicles, and particularly to light-weight soft wing-sails for propelling such vehicles. The invention is especially useful in water vehicles, and is therefore described below with respect to such application, but it will be appreciated that the invention could also be used in other applications, such as for propelling vehicles over land or ice.

In recent years, a number of soft wing-sails have been proposed in order to better exploit the wind forces for propelling the vehicle. Examples of various constructions of soft wing-sails heretofore proposed are described in Fuller U.S. Pat. No. 4,685,410; Magrini U.S. Pat. No. 5,271,349; Milidragivic U.S. Pat. No. 5,868,092; Gonen U.S. Pat. No. 6,863,008; and in U.K. Patent Spencer 2,008,514.

However, the main disadvantages of the structure of soft wing-sails proposed were cumbersome and/or heavy structure that is hard to use and to fix damages at sea and, has negative effects on boats stability and performance. Also, complicated structure with many moving parts tends to jam and stick and therefore is less safe at sea.

There is therefore a definite need for a simple and light weight soft wing-sail structure, having very few moving parts, permitting hoisting and reefing each of the sail panels independently and providing all the benefits of a wing-sail over standard sails.

OBJECTS AND BRIEF SUMMARY OF THE PRESENT INVENTION

An object of the present invention is to provide a light-weight and simple construction of soft wing-sail, for wind-propelled vehicle, having a number of advantages in the above respects, as will be described more particularly below.

According to a broad aspect of the present invention, there is provided a wind-propelled vehicle comprising: a light-weight, soft wing-sail for propelling the vehicle, and including a front sail panel defining the leading edge of the wing-sail, and a pair of side sail panels each independently mounted with respect to each other and with respect to the front sail panel, the pair of side panels defining the trailing edges of the wing-sail; a vertical mast carrying the wing-sail and rotatably mounted at its lower end about a vertical axis on the vehicle; a plurality of spreaders having inner ends fixed to the mast at longitudinally spaced locations thereon; a pair of tracks extending along opposite sides of the mast and fixed to the mast only at the top thereof, the tracks also being fixed to the outer ends of the spreaders; a plurality of sliders fixed to the sail panels and slidable along the tracks to permit each of the sail panels to be hoisted and reefed independently; a boom pivotally mounted to the lower end of the mast; and clews at the trailing edges of the side sail panels secured to the boom such as to permit even rearward tensioning and independent sliding of the trailing edges of the side panels along the boom when trimming the airfoil shape by changing the angle of the boom around the mast.

According to further features in the described preferred embodiment, each of the tracks has fore and aft grooves for independently receiving sliders. The fore grooves receive sliders secured at one side to one end of the leading edge panel and at the other side to the other end of the leading edge panel, and the aft grooves of these tracks receive sliders secured to the front part of the respective trailing edge side panels.

In addition, each of the sliders includes a batten receptacle for receiving the batten of the respective sail panel. In addition, the tracks grooves receiving sliders secured to each of the sail panels, thereby permitting hoisting and reefing the sail panels either independently or together.

According to further features in the described preferred embodiment, the sliders are secured to both ends of the front sail panel and to each of the front ends of the side sail panels. Each of the sliders includes a batten receptacle for receiving the batten of the respective sail panel. In addition, each of the tracks includes fore and aft grooves for independently receiving its sliders, thereby permitting hoisting and reefing the sail panels independently or together.

According to still further features in the described preferred embodiment, each of the tracks covers the batten receptacles and the sail panel ends, and is of a streamlined configuration to permit streamlined and uninterrupted airflow around the wing sail.

According to still further features in the described preferred embodiment, the spreaders have a swept-back configuration, and the swept-back upper spreader is of shorter transverse dimension than the swept-back lower spreader to thereby mount the pair of vertical tracks along axes which converge from the lower end to the upper end with respect to the vertical rotary axis of the vertical mast. In addition, the leading edge battens are stiff at both ends and flexible in the middle permitting the battens to assume a changeable U-shape as they slide along the tracks.

According to still further features in the described preferred embodiment, the clews are coupled to the boom by a block tensioned and movable forwardly by an outhaul line to maintain even tension on both clews. The latter block is coupled to the clews such as to permit the windward trailing edge to slide rearwardly relative to the boom, and the leeward side of the trailing edge to slide forwardly relative to the boom, when the angle between the mast and the boom is changed.

In the described preferred embodiment, the wing-sail further comprises a ram secured to the lower spreader and to the boom to permit fixing the angle between the leading edge of the wing sail to the trailing edge of the wing sail. The effective length of the ram is changeable by a drive to permit trimming of the angle according to the desired airfoil shape.

According to still further features in the described preferred embodiment, a reefing block coupling a reefing line to reefing points on the trailing edges of said side sail panels permitting reefing said side sail panels together and under even tension such as to enable the windward side of the trailing edge to slide rearwardly relative to the boom, and the leeward side of the trailing edge to slide forwardly relative to the boom, when the wing is reefed and the angle between the mast and the boom is changed in order to trim the airfoil shape. In addition, the outer ends of the bottom spreader are secured to the opposite sides of the lower end of the mast such that the mast, the spreaders and the tracks provide a stiff and light-weight structure for supporting the mast from whipping.

As will be described more particularly below, such a light-weight and simple construction permits the soft wing-sail to be hoisted, reefed, and lowered, either as one wing-sail unit, or each of the sail panels independently. The higher efficiency capability of such a light-weight soft wing-sail enables the vehicle to attain higher speeds of travel and point higher up wind, and at the same time, to reduce the size of the sails and rigging and to reduce the weight of the vehicle. Also, it enables a safe and easy operation of a vehicle driven by the wind.

Further features and advantages of the invention will be apparent from the description below.

BRIEF DESCRIPTION OF THE DRAWINGS

The invention is herein described, by way of example only, with reference to the accompanying drawings, wherein.

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

DESCRIPTION OF A PREFERRED EMBODIMENT

Figure 1:
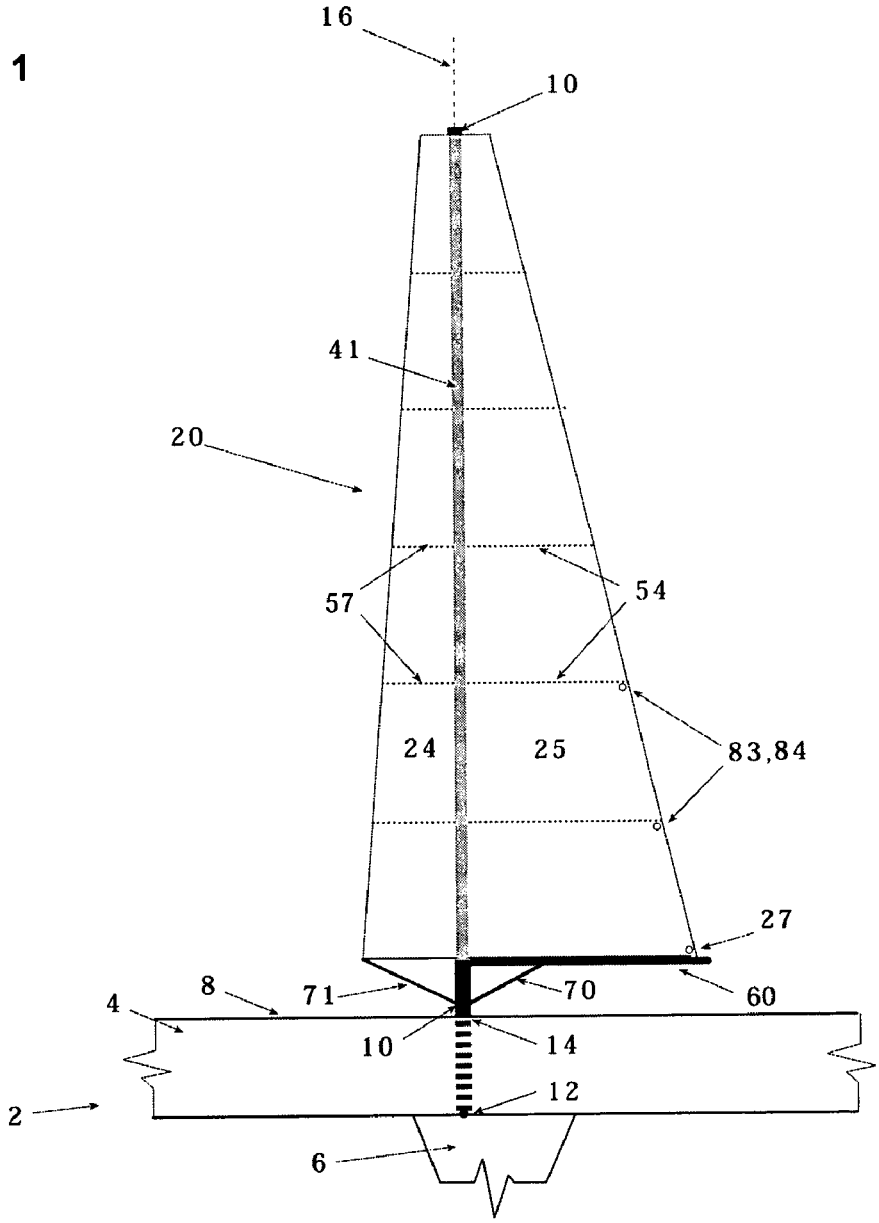
FIG. 1 is a diagrammatic side-elevational view of a wind-propelled vehicle including a light-weight soft wing-sail constructed in accordance with the present invention for propelling the vehicle.

With reference to FIG. 1, there is illustrated a wind-propelled water vehicle, generally designated 2, including a hull 4, a keel 6, and a deck 8. Also illustrated in FIG. 1 is a free-standing and rotatable mast, generally designated 10, vertically mounted for rotation by means of a ball 12 at the level of keel 6, and a roller bearing 14 at the level of the deck 8, such as to permit rotation of the mast about its vertical axis 16.

Vertical mast 10 carries a light-weight, soft wing-sail, generally designated 20, for propelling the vehicle. As shown particularly in FIG. 2, wing-sail 20 is supported on mast 10 such as to assume a selected airfoil shape having a leading edge defined by a U-shaped panel 24 fore of the mast, and a trailing edge aft of the mast defined by two spaced side panels 25, 26. As shown particularly in FIGS. 1, 2 and 6, the lower aft side of the trailing edge side panels 25, 26 includes clews 27, 28.

The selected airfoil shape of the wing-sail 20 is effected by a spreader assembly, including upper spreaders 31*a*, 31*b* fixed to the upper end of mast 10, lower spreaders 32*a*, 32*b*, fixed to the lower end of the mast, and intermediate spreaders 33*a*, 33*b*, fixed at an intermediate portion of the mast. Three spreaders would be suitable for a relatively small vessel, but it will be appreciated that the number of spreaders would depend on the size of the vessel. For example, a medium-sized vessel including five spreaders has also been constructed.

Figure 2:
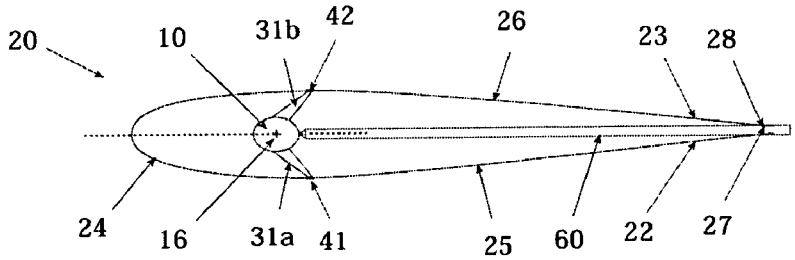
FIG. 2 is a diagrammatic plan view illustrating the wing-sail of FIG. 1.

FIG. 2 diagrammatically illustrates the upper spreaders 31*a*, 31*b*, fixed to the upper end of mast 10. As shown in FIG. 2, the spreaders 31*a*, 31*b* are swept-back to support the wing-sail 20 and define the desired airfoil shape. Corresponding spreaders 32, 33, would be of similar construction, except that their respective lengths would be of longer dimension to support the wing-sail 20 and to maintain the airfoil proportions in the triangular configuration illustrated in FIG. 1.

Figure 4:
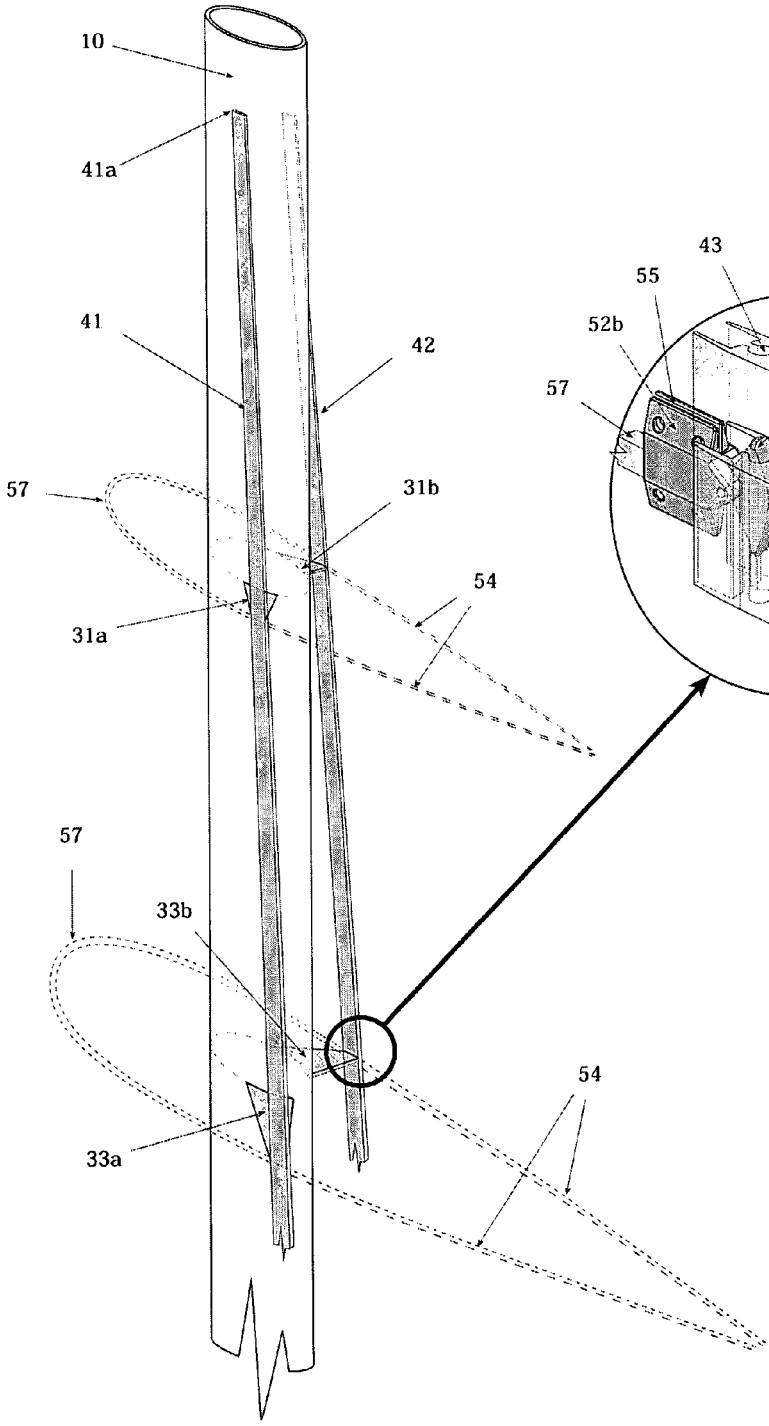
FIG. 4 is a diagrammatic fractional view illustrating the upper end of the mast, spreaders, tracks, battens and particularly the attachment of the wing-sail thereto.

The illustrated wing-sail further includes a pair of tracks 41, 42, extending along opposite sides of the mast 10, and fixed to the upper and lower spreaders 31, 32, and also to all intermediate spreaders 33 if provided. As shown particularly in FIG. 4, the upper end of each of the tracks 41, 42 is secured to the mast 10 at securement points 41*a*. In addition, since the spreaders increase in length from the upper spreaders 31*a*, 31*b* towards the lower spreaders 32*a*, 32*b*, the two tracks 41, 42 are mounted to the opposite sides of the mast 10 along axes which converge from the lower end towards the upper end of the vertical rotary axis 16 of mast 10.

Figure 5:
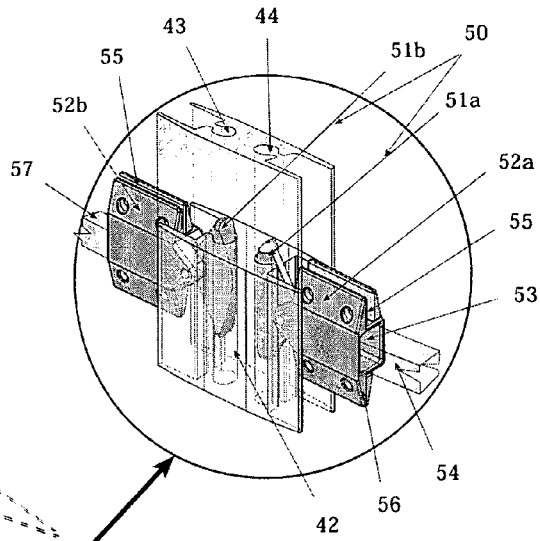
FIG. 5 is an enlarged fragmentary view more particularly illustrating the encircled portion of FIG. 4, namely one of the attachment points of the wing-sail so as to be slidable along its respective track.

A slider assembly, generally designated 50 particularly illustrated in FIG. 5, fixed to the sail panel 24, 25 and 26, of wing sail 20 are slidable along the tracks 41, 42 to permit the sail panels to be hoisted and reefed independently, or together if so desired.

As shown in FIG. 5, track 42 (and similarly track 41) is formed with a fore groove 43 and an aft groove 44. Each of these grooves receives a slider assembly 50, including a slider element 51*a*, 51*b*, slidable along the respective groove, and a sail panel securing element 52*a*, 52*b*, for receiving and securing the respective sail panel. Each sail panel securing element 52*a*, 52*b*, includes a batten receptacle 53, for receiving the batten 54,57, of the respective sail panel, and a pair of opposed slots 55, 56, for receiving the respective edges of the sail panel.

FIG. 5 illustrates slider 51*a* slidable within the aft groove 44 of the track, and slider 51*b* slidable within the fore groove 43 of the track. The batten receptacles would be appropriately dimensioned to accommodate their respective battens 54,57. The batten 57 on the front sail panel would be flexible in the middle region permitting the batten to assume a U-shape defining the leading edge of the wing sail and stiffer at the aft ends received within their respective receptacles.

As further shown in FIGS. 1, 2, 6 and 7, the vehicle further comprises a boom, generally designated 60, pivotally mounted to the lower end of mast 10. The clews 27, 28 of the two side sail panels, 25, 26 are secured to the boom by tensioning lines 61, 62 wound over sheaves 63, 64, coupled to the boom by a block 65 pulled by an outhaul line 66 to maintain even tension on both clews. Outhaul line 66, acting on tension lines 61, 62 coupled to the two clews 27, 28 through block 65 and sheaves 63, 64, permit changing the angle between the center lines of the leading edge and the center line of the trailing edge of the wing-sail. The foregoing arrangement permits the windward trailing edge clew to slide backward relative to the boom, and the leeward trailing edge clew to slide forward relative to the boom, maintaining even tension on both clews, when the airfoil shape is trimmed by changing the angle between boom 60 and the mast 10.

Figure 3:
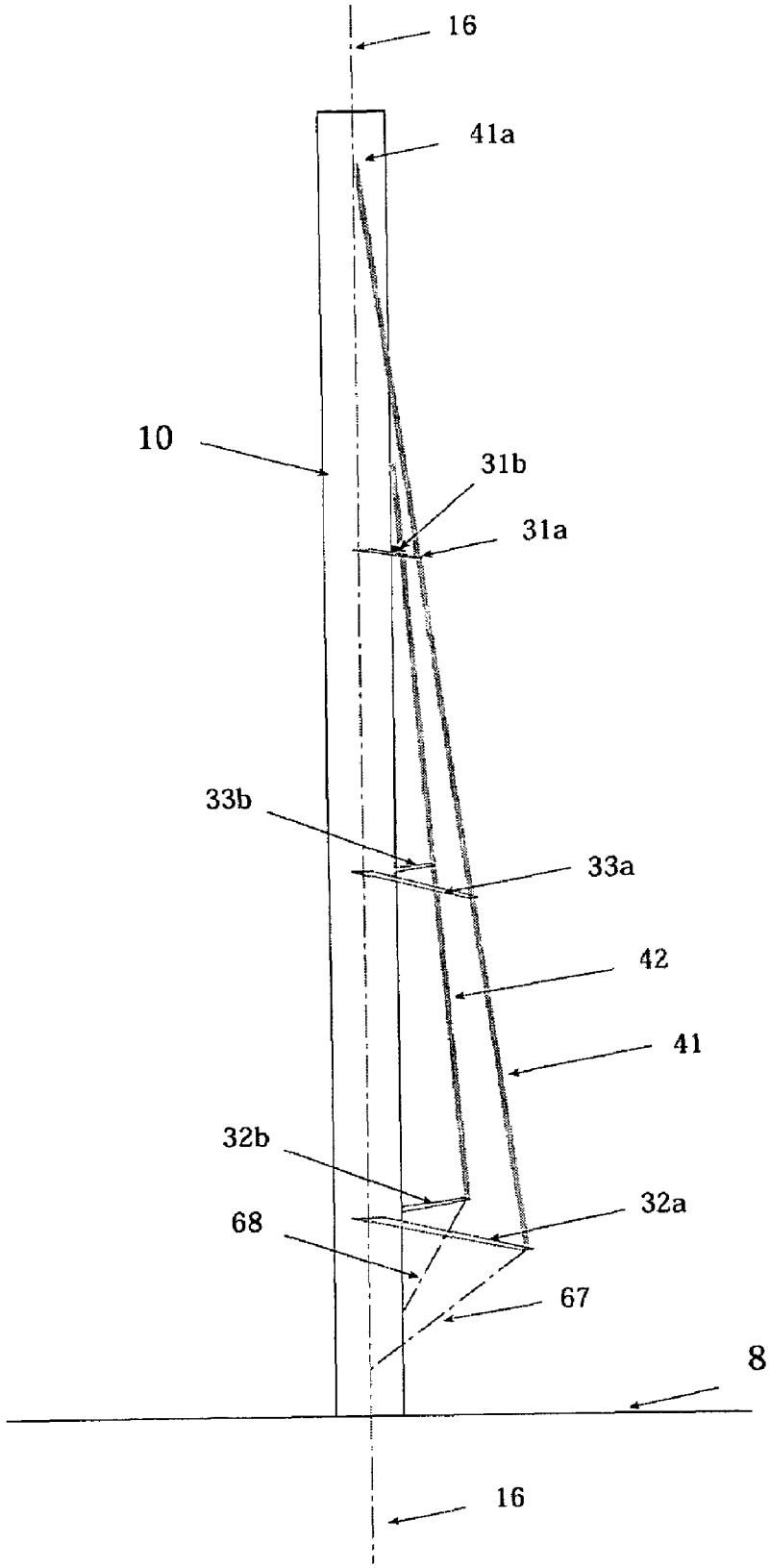
FIG. 3 is a side-elevational view of the structure of the wing-sail of FIGS. 1 and 2 attached to the mast.

The structure comprised of mast 10, tracks 41,42, spreaders 31,32,33 and two tension cables 67,68 (FIG. 3) at the outer ends of the lower spreaders 32 to the bottom of mast 10, provide a stiff and light-weight structure for supporting the mast from whipping.

Figure 7:
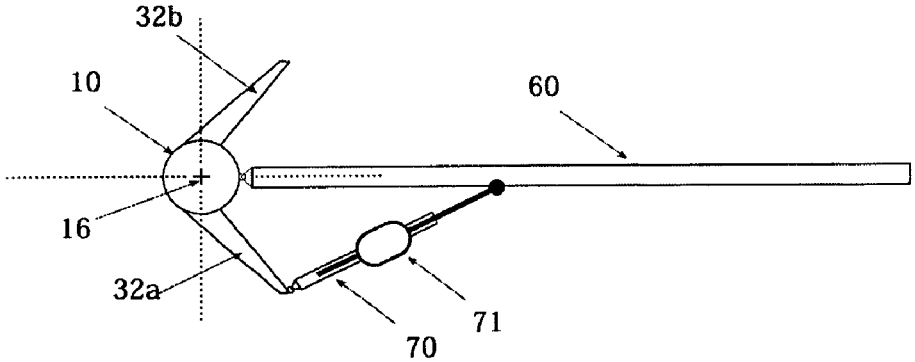
FIG. 7 is a diagrammatic plan view illustrating the ram secured to the boom and to the lower spreader to pivot the boom and thereby trim the angle defined by the center lines of the leading and trailing edges of the wing-sail.

As shown particularly in FIG. 7, the vehicle further includes a ram, generally designated 70, secured to the lower spreader 32 and to the boom to permit fixing the leading edge of the wing-sail to the trailing edge of the wing-sail, and thereby to prevent spontaneous change of the angle between the center line of the leading edge and the center line of the trailing edge. A motor, e.g., hydraulic or electric, enables the effective length of the ram to be changed, and thereby permits changing and trimming of the angle according to a desired airfoil shape.

Figure 6:
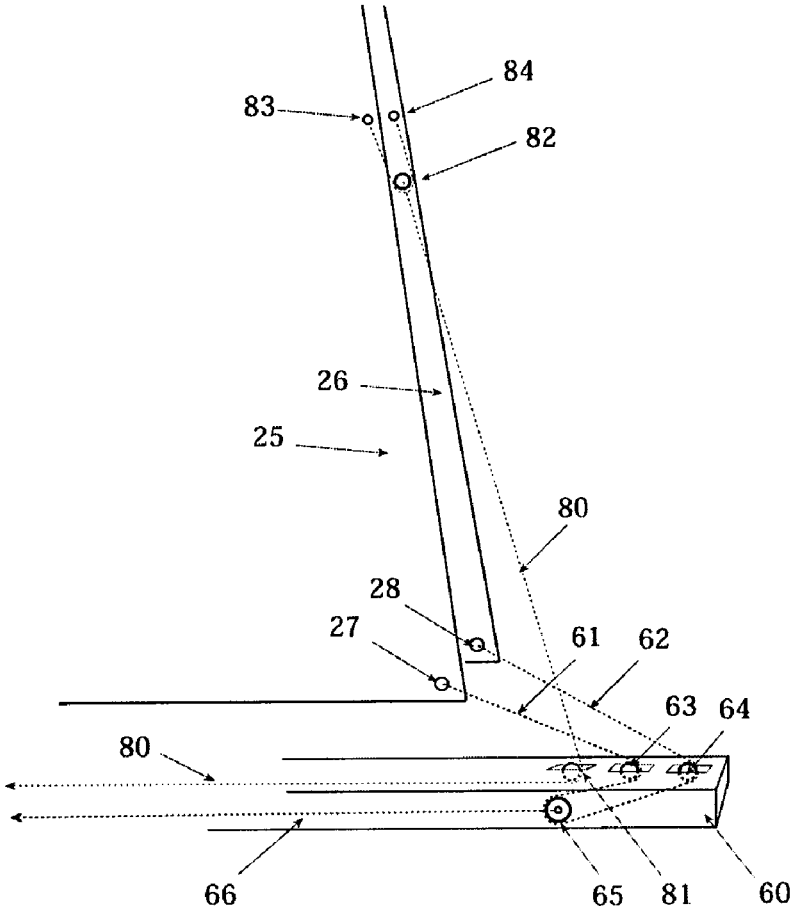
FIG. 6 is a diagrammatic view illustrating the aft side of the boom that is pivotally coupled to the mast; an outhaul line coupled through a block to the clews of both trailing edges of the wing-sail such as to permit even rearward tension and independent sliding of each of the trailing edges relative to the boom; and also the reefing system for reefing the wing-sail and having the same features of even tension and independent trailing edge sliding relative to the boom when reefed.

As illustrated particularly in FIG. 6, the vehicle includes a reefing line 80 coupled via a sheave 81 on boom 60, and by a block 82 to two reefing points 83, 84 of the trailing edges 25, 26 to permit the sail panels to be reefed together and, to independently slide forward and backward along the boom, maintaining even tension on both reefing points, when the airfoil shape is changed. A separate reefing line (not seen in FIG. 8) is provided for the front sail panel 24 to permit that panel to be reefed independently. Because of operational convenience, there is one reefing line for the leading edge sail panel, and only one reefing line for the two trailing edge sail panels.

Figure 8:
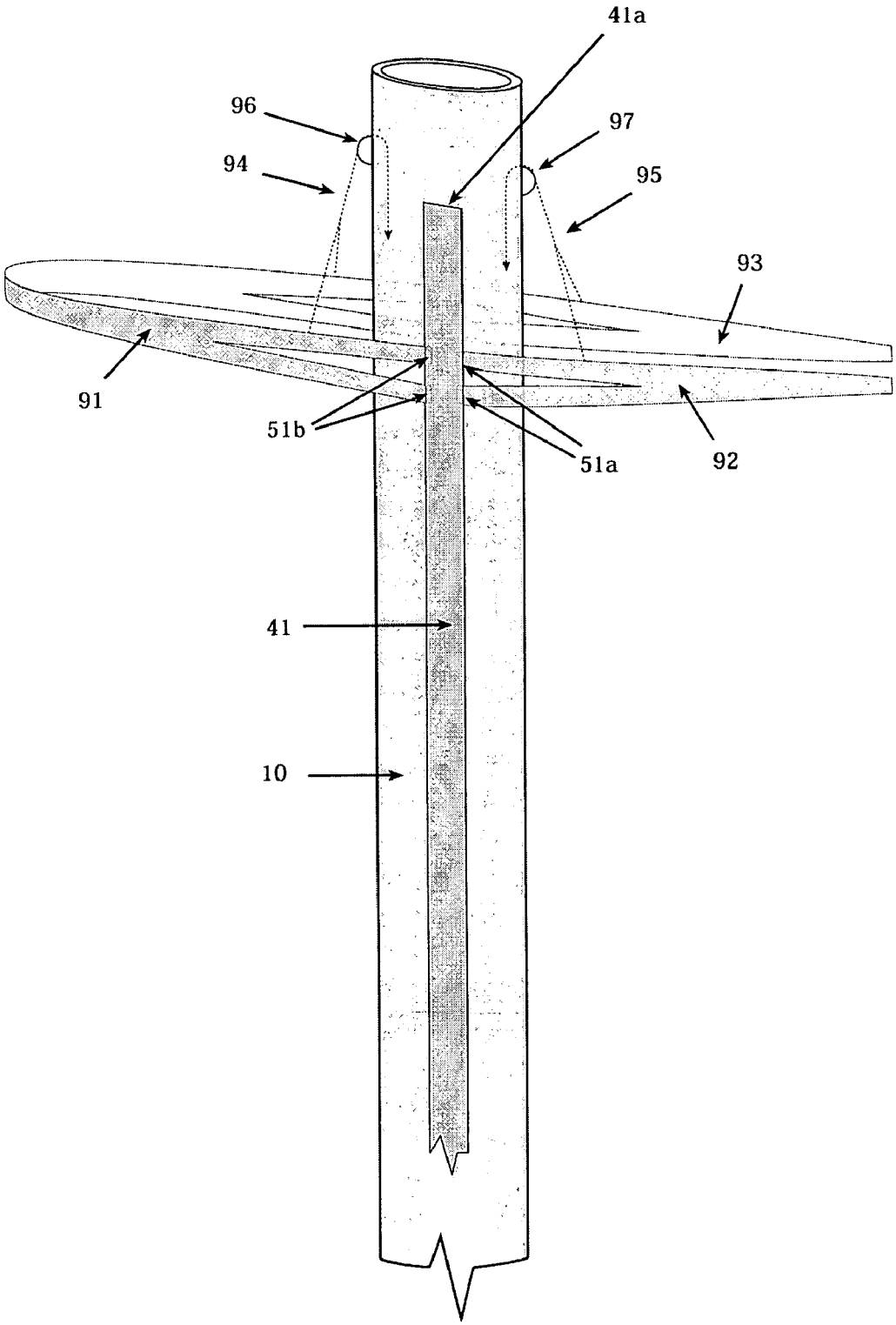
FIG. 8 diagrammatically illustrates the headboards at the upper end of the wing-sail.

FIG. 8, illustrates the headboard at the upper end of the wing-sail which is made of solid material, and is constituted of three parts: the leading edge 91, the left trailing edge 92, and the right trailing edge 93. Three sail panels 24, 25, 26, are secured to their respective headboards, 91, 92 and 93.

The leading edge headboard 91 coupled to the leading sail panel 24 is hoisted by a halyard 94 wound over a sheave 96 fixed to the upper end of mast 10; whereas the two trailing edge headboards 92, 93, fixed to the sail panels 25, 26 are hoisted by pulling another halyard 95 wound over a sheave 97 fixed to the upper end of mast 10 at the opposite side from sheave 96.

It is thus seen, for operational simplicity, the side sail panels are hoisted and reefed together, but if the line to each of the side panels is connected independently, the side panels can also be hoisted and reefed independently. Sliders, similar to those illustrated in FIG. 5, are secured to the headboards 91, 92, 93, to permit sliding along tracks 41 and 42 at the opposite sides of the mast.

The manner of operating the wind-propelled vehicle illustrated in the drawings will be apparent from the above description. Thus, the structure comprised of mast 10, tracks 41, 42 secured to the mast top and to each of the swept-back spreaders 31, 32, 33 and tensioning cables 67, 68, secured to the mast bottom as shown particularly in FIG. 3, carry the wing-sail 20 and stiffen the mast 10 so as to prevent the top of the mast from whipping. The three sail panels, 24, 25, 26 define the wing-sail skin, and the airfoil proportion and shape are defined by the length of the boom 60, of the spreaders 30 and of the leading edge battens. The sliders 50, secured to the sail panels 24-26 via the batten receptacles 53 of each slider, as shown particularly in FIG. 5, slide up and down within grooves 43, 44 of the two tracks 41, 42 such as to permit hoisting, reefing and taking down the sail panels. Since the three sail panels 24-26 are actually not connected to each other, the arrangement permits selectively hoisting and reefing each of the sail panels, or alternatively, all the sail panels together.

The tracks 41, 42 (FIG. 5) are shaped so as to cover the sliders 50, and batten receptacles 52*a*, 52*b*, secured to the sail panels 24-26 such that airflow around the wing-sail is streamlined and uninterrupted. Clews 27, 28 (FIG. 6) of the side sail panels 25, 26 are coupled to boom 60 by tension cables 61, 62 such that by pulling outhaul line 66, block 65 is pulled forward and keeps even tension on the cables 61, 62, and even rearward tension on the clews 27, 28. This permits the windward clew and respective trailing edge to move backwards relative to the boom, and the leeward clew and respective trailing edge to move forwards relative to the boom, when the airfoil shape is trimmed by changing the angle between the mast 10 and the boom 60 is changed.

Ram 70 (FIG. 7) is secured to the lower spreader 32 and to boom 60, fixes the leading edge of the wing-sail via the boom to the trailing edge, resulting in one wing-sail unit that rotates with the mast. Ram 70 thus secures the boom 60 to the mast 10 such as to prevent spontaneous change of the angle between them under wind pressure. Motor 71 (e.g., hydraulic or electric) changes the length of ram 70, and thereby permits trimming of the angle between the leading edge axis and trailing edge axis defined by the boom according to the desired airfoil camber.

It will thus be seen that the wing-sail described above has a number of advantages, including: light weight structure; small number of moving parts; easy to use; easy to hoist, reef, fold and take down; permits handling each of the sails independently; easy to fix damages at sea; and simple and light weight construction to fit in any boat size.

While the invention has been described above with respect to one example of wind-driven water vehicles, it will be appreciated that the invention could also be implemented in other wind-driven water vehicles, and in wind-driven land vehicles or ice vehicles. Many other variations, modifications and applications of the invention will be apparent.

What is claimed is:

1. A wind-propelled vehicle, comprising:

a light-weight, soft wing-sail for propelling the vehicle, and including a front sail panel defining the leading edge of the wing-sail, and a pair of side sail panels each independently mounted with respect to each other and with respect to said front sail panel, said pair of side panels defining the trailing edges of the wing-sail;

a vertical mast carrying said wing-sail and rotatably mounted at its lower end about a vertical axis on said vehicle;

a plurality of spreaders having inner ends fixed to said mast at longitudinally spaced locations thereon;

a pair of tracks extending along opposite sides of said mast and fixed to said mast only at the top thereof, said tracks also being fixed to the outer ends of the spreaders;

a plurality of sliders fixed to said sail panels and slidable along said tracks to permit said sail panels to be hoisted and reefed independently;

a boom pivotally mounted to the lower end of said mast; and clews at the trailing edges of said side sail panels secured to the boom such as to permit even rearward tensioning and independent sliding of the trailing edges of said side panels along the boom when trimming the airfoil shape by changing the angle of the boom around the mast.

2. The vehicle according to claim 1, wherein said sliders are secured to both ends of said front sail panel and to the front ends of said side sail panels to permit each of said sail panels to be hoisted and reefed independently from the others or together with the others.

3. The vehicle according to claim 2, wherein each of said sliders includes a batten receptacle for receiving the batten of the respective sail panel.

4. The vehicle according to claim 3, wherein each of said tracks includes fore and aft grooves for independently receiving its sliders, thereby permitting hoisting and reefing said sail panels independently or together.

5. The vehicle according to claim 4, wherein each of said tracks covers the batten receptacles and the sail panel ends and is of a streamlined configuration to permit streamlined and uninterrupted airflow around said wing-sail.

6. The vehicle according to claim 4, wherein said spreaders have a swept-back configuration, and said swept-back upper spreader is of shorter transverse dimension than said swept-back lower spreader to thereby mount said pair of vertical tracks along axes which converge from the lower end to the upper end with respect to the vertical rotary axis of said vertical mast.

7. The vehicle according to claim 6, wherein the leading edge battens are stiff at both ends and flexible in the middle permitting the battens to assume a changeable U-shape as they slide along the tracks.

8. The vehicle according to claim 1, wherein said clews are coupled to said boom by a block tensioned and movable forwardly by an outhaul line to maintain even tension on both clews.

9. The vehicle according to claim 8, wherein said block is coupled to the clews such as to permit the windward trailing edge to slide rearwardly relative to the boom, and the leeward side of the trailing edge to slide forwardly relative to the boom, when trimming the airfoil shape by changing the angle between the mast and the boom.

10. The vehicle according to claim 1, wherein said wing-sail further comprises a ram secured to the lower spreader and to said boom to permit fixing the angle between the leading edge of the wing-sail to the trailing edge of the wing-sail.

11. The vehicle according to claim 10, wherein the effective length of said ram is changeable by a drive to permit trimming of the angle according to a desired airfoil shape.

12. The vehicle according to claim 1, wherein said boom further includes a reefing block coupling a reefing line to reefing points on the trailing edges of said side sail panels permitting reefing said side sail panels together and under even tension such as to enable the windward side of the trailing edge to slide rearwardly relative to the boom, and the leeward side of the trailing edge to slide forwardly relative to the boom, when the wing is reefed and the angle between the mast and the boom is changed in order to trim the reefed wing airfoil shape.

13. The vehicle according to claim 1, wherein the structure comprised of said boom, said spreaders, said tracks and tension cables secure the outer ends of the bottom spreaders to the opposite sides of the lower end of said mast, provide a stiff and light-weight structure for supporting the mast from whipping.

* * * * *